US005891836A

United States Patent [19]

Kacher

[11] Patent Number: 5,891,836

[45] Date of Patent: Apr. 6, 1999

[54] LIGHT-DUTY LIQUID OR GEL DISHWASHING DETERGENT COMPOSITIONS WHICH ARE MICRO EMULSIONS AND WHICH HAVE DESIRABLE GREASY FOOD SOIL REMOVAL AND SUDSING CHARACTERISTICS

[75] Inventor: Mark Leslie Kacher, Mason, Ohio

[73] Assignee: The Procter & Gamble Company, Cincinnati, Ohio

[21] Appl. No.: 79,414

[22] Filed: May 14, 1998

Related U.S. Application Data

[60] Provisional application No. 60/046,691 May 16, 1997.

[51] Int. Cl.[6] ..... C11D 1/94; C11D 3/44

[52] U.S. Cl. ..... 510/237; 510/365; 510/417; 510/423; 510/424; 510/427; 510/433; 510/502

[58] Field of Search ..... 510/427, 237, 510/423, 417, 433, 125, 424, 502, 124, 306, 341, 350, 365

[56] References Cited

U.S. PATENT DOCUMENTS

| | | | |
|---|---|---|---|
| 5,512,699 | 4/1996 | Connor et al. | 564/153 |
| 5,531,938 | 7/1996 | Erilli | 510/417 |
| 5,534,197 | 7/1996 | Scheibel et al. | 510/356 |
| 5,776,872 | 7/1998 | Giret et al. | 510/124 |

*Primary Examiner*—Margaret Einsmann
*Assistant Examiner*—Gregory E. Webb
*Attorney, Agent, or Firm*—Steven R. Chuey; Kim W. Zerby; Jacobus C. Rasser

[57] ABSTRACT

Disclosed are light-duty liquid or gel dishwashing detergent compositions that are especially useful for the manual washing of heavily soiled dishware. Such compositions are in the form of oil-in-water or bicontinuous microemulsions. They essentially contain an alkyl ether sulfate-based anionic surfactant, a polyhydroxy fatty acid amide-based nonionic surfactant component, a suds booster which is preferably an amine oxide, an aqueous liquid carrier, a liquid hydrocarbon such as isoparaffin and an glycol ether microemulsion-forming solvent.

2 Claims, No Drawings

LIGHT-DUTY LIQUID OR GEL DISHWASHING DETERGENT COMPOSITIONS WHICH ARE MICRO EMULSIONS AND WHICH HAVE DESIRABLE GREASY FOOD SOIL REMOVAL AND SUDSING CHARACTERISTICS

CROSS REFERENCE

Under 35 U.S.C §119(e), this application claims the benefit of U.S. Provisional Application 60/046,691, filed on May 16, 1997.

TECHNICAL FIELD

The present invention relates to liquid or gel dishwashing detergent compositions suitable for use in manual dishwashing operations. These compositions are in the form of microemulsions and contain detergent surfactants, solvents, suds boosters, liquid hydrocarbon grease solubilizers and other adjuvants which in combination serve to impart consumer preferred greasy food soil cleaning and sudsing characteristics to such dishwashing detergent products.

BACKGROUND OF THE INVENTION

Light-duty liquid (LDL) or gel detergent compositions useful for manual dishwashing are well known in the art. Such products are generally formulated to provide a number of widely diverse performance and aesthetics properties and characteristics. First and foremost, liquid or gel dishwashing products must be formulated with types and amounts of surfactants and other cleaning adjuvants that will provide acceptable solubilization and removal of food soils, especially greasy soils, from dishware being cleaned with, or in aqueous solutions formed from, such products.

Heavily soiled dishware can present special problems during manual dishwashing operations. Articles such as plates, utensils, pots, pans, crockery and the like may be heavily soiled in the sense that relatively large amounts of food soils and residues may still be found on the dishware at the time such soiled dishware is to be manually washed. Dishware may also be heavily soiled in the sense that food soil residues are especially tenaciously adhered or stuck to the surfaces of the dishware to be cleaned. This can result from the type of food soils present or from the nature of the dishware surfaces involved. Tenacious food soil residues may also result from the type of cooking operations to which the soiled dishware had been subjected.

When heavily soiled dishware is to be manually cleaned, very often highly concentrated, or high concentrations of, dishwashing detergent products are used. Frequently, this will involve direct application to the soiled dishware of a liquid or gel product in its undiluted or neat form. For such application, one detergent composition adjuvant which can be especially useful for solubilizing greasy food soils is a liquid hydrocarbon such as isoparaffin. Hydrocarbon materials, however, can be difficult to incorporate into aqueous detergent compositions without causing undesirable separation of the product into discernible oil and water phases.

One approach for incorporating hydrocarbons into aesthetically acceptable dishwashing detergent products involves the preparation of such products in the form of microemulsions. Preparation of stable microemulsions, however, requires selection of the right combination of surfactants, solvents, oil, liquid carrier components and other detergent composition adjuvants.

In addition to being suitable for cleaning dishware, LDL or gel compositions will also desirably possess other attributes that enhance the aesthetics or consumer perception of the effectiveness of the manual dishwashing operation. Thus, useful hand dishwashing liquids or gels should also employ materials that enhance the sudsing characteristics of the wash solutions formed from such products. Sudsing performance entails both the production of a suitable amount of suds in the wash water initially, as well as the formation of suds which last well into the dishwashing process. This typically requires incorporation of suds boosting surfactants which may also need to be incorporated into products in the form of microemulsions.

Given the foregoing, there is a continuing need to formulate manual dishwashing liquids and gels that provide an acceptable and desirable balance between cleaning performance, product form and product aesthetics. Accordingly, it is an object of the present invention to provide light-duty liquid or gel dishwashing compositions which are especially effective at removing greasy food soils from dirty dishware when such compositions are used in the context of a manual dishwashing operation.

It is a further object of this invention to provide such compositions in the form of microemulsions that can be used for manual dishwashing in either a direct application to dishware context or in an aqueous dishwashing solution context.

It is a further object of the present invention to realize such compositions that provide suitable and desirable sudsing performance.

It has been found that certain selected combinations of cleaning surfactants, suds boosters, liquid hydrocarbons, microemulsion-forming surfactants and other adjuvants can be made to provide dishwashing compositions that achieve the foregoing objectives. The elements of these selected combinations of ingredients are described as follows:

SUMMARY OF THE INVENTION

The present invention relates to light-duty liquid or gel detergent compositions having especially desirable greasy soil removal and sudsing performance when such compositions are used to clean heavily soiled dishware. Such compositions are in the form of oil-in-water (o/w) or bicontinuous microemulsions.

These microemulsion compositions comprise A) from about 20% to 40% of a specific type of an anionic surfactant component; B) from about 3% to 10% of a certain type of nonionic surfactant component; C) from about 2% to 6% of a suds booster/stabilizer; D) from about 50% to 75% of an aqueous liquid carrier; E) from about 2% to 7% of a liquid hydrocarbon component; and F) from about 2% to 10% of a microemulsion-forming solvent.

In these compositions, the anionic surfactant component essentially comprises alkyl ether sulfates containing from about 8 to 18 carbon atoms in the alkyl group. These alkyl ether sulfates also contain from about 1 to 6 moles of ethylene oxide per molecule.

The nonionic surfactant component of the compositions herein essentially comprises $C_{8-18}$ polyhydroxy fatty acids amides. In the nonionic surfactant component, such polyhydroxy fatty acids amides may also be combined with from about 0.2% to 2% of the composition of a nonionic co-surfactant. This nonionic co-surfactant is selected from $C_{8-18}$ alcohol ethoxylates having from about 1 to 15 moles of ethylene oxide, ethylene oxide-propylene oxide block co-polymer surfactants and combinations of these nonionic co-surfactants.

The suds booster/stabilizer utilized in the compositions herein are selected from betaine surfactants, hydroxy-free fatty acid amides, amine oxide semipolar nonionic surfactants and $C_{8-22}$ alkylpolyglycosides. Combinations of these suds booster/stabilizers may also be utilized.

The microemulsion-forming solvent is a glycol ether. This material serves to form an oil-in-water or bicontinuous microemulsion from the aqueous liquid carrier and liquid hydrocarbon components of the compositions herein.

The foregoing essential components, as well a number of additional optional ingredients, can be combined in conventional manner to form the light-duty liquid or gel dishwashing detergent microemulsions of this invention.

DETAILED DESCRIPTION OF THE INVENTION

The light-duty liquid or gel dishwashing detergent compositions of the present invention contain six essential components. These components are:

(1) a certain type of anionic surfactant;

(2) certain nonionic surfactants;

(3) certain suds boosters/stablizers;

(4) an aqueous liquid carrier;

(5) a liquid hydrocarbon; and (6) a glycol ether microemulsion-forming solvent.

A wide variety of optional ingredients can also be added to compliment the performance, rheological and/or aesthetics characteristics of the compositions herein.

The essential and optional components of the instant light duty liquid or gel dishwashing detergents are described in detail as follows, along with composition preparation and use. In describing the compositions of the present invention, it should be noted that the term "light-duty dishwashing detergent composition" as used herein refers to those compositions which are employed in manual (i.e. hand) dishwashing. Such compositions are generally high sudsing or foaming in nature. In describing the compositions of this invention, it should also be noted that all concentrations and ratios are on a weight basis unless otherwise specified.

Anionic Surfactant Component

The compositions herein essentially contain from about 20% to 40% of an anionic surfactant component. More preferably the anionic surfactant component comprises from about 25% to 35% of the compositions herein.

The anionic surfactant component essentially comprises alkyl ether sulfates. Alkyl ether sulfates are also known as alkyl polyethoxylate sulfates. These ethoxylated alkyl sulfates are those which correspond to the formula:

$$R'—O—(C_2H_4O)_nSO_3M$$

wherein R' is a $C_8$–$C_{18}$ alkyl group, n is from about 1 to 6, and M is a salt-forming cation. Preferably, R' is $C_{10-16}$ alkyl, n is from about 1 to 4, and M is sodium, potassium, ammonium, alkylammonium, or alkanolammonium. Most preferably, R' is $C_{12}$–$C_{16}$, n is from about 1 to 3 and M is sodium. The alkyl ether sulfates will generally be used in the form of mixtures comprising varying R' chain lengths and varying degrees of ethoxylation. Frequently such mixtures will inevitably also contain some unethoxylated alkyl sulfate materials, i.e., surfactants of the above ethoxylated alkyl sulfate formula wherein n=0.

Nonionic Surfactants

The compositions herein also essentially contain from about 3% to 10% of a certain type of nonionic surfactant component. More preferably, the nonionic surfactant component will comprise from about 4% to 6% of the compositions herein.

One essential type of nonionic surfactant which is present in the compositions herein comprises the $C_{8-18}$ polyhydroxy fatty acid amides. These materials are more fully described in Pan/Gosselink; U.S. Pat. No. 5,332,528; Issued Jul. 26, 1994, which are incorporated herein by reference. These polyhydroxy fatty acid amides have a general structure of the formula:

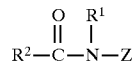

wherein $R^1$ is H, $C_1$–$C_4$ hydrocarbyl, 2-hydroxyethyl, 2-hydroxypropyl, or a mixture thereof; $R^2$ is $C_8$–$C_{18}$ hydrocarbyl; and Z is a polyhydroxylhydrocarbyl having a linear hydrocarbyl chain with at least 3 hydroxyls directly connected to the chain, or an alkoxylated derivative thereof. Examples of such surfactants include the $C_{10}$–$C_{18}$ N-methyl, or N-hydroxypropyl, glucamides. The N-propyl through N-hexyl $C_{12}$–$C_{16}$ glucamides can be used for lower sudsing performance. Polyhydroxy fatty acid amides will preferably comprise from about 3% to 5% of the compositions herein.

In the nonionic surfactant component of the compositions herein, the polyhydroxy fatty acid amides hereinbefore described may be combined with certain other types of nonionic co-surfactants. These other types include ethoxylated alcohols and ethylene oxide-propylene oxide block co-polymer surfactants, as well as combinations of these nonionic co-surfactant types.

Ethoxylated alcohol surfactant materials useful in the nonionic surfactant component herein are those which correspond to the general formula:

$$R^1—O—(C_2H_4O)_nSO_3M$$

wherein $R^1$ is a $C_8$–$C_{18}$ alkyl group and n ranges from about 1 to 15. Preferably $R^1$ is an alkyl group, which may be primary or secondary, that contains from about 9 to 15 carbon atoms, more preferably from about 10 to 14 carbon atoms. Preferably the ethoxylated fatty alcohols will contain from about 2 to 12 ethylene oxide moieties per molecule, more preferably from about 8 to 12 ethylene oxide moieties per molecule. The ethoxylated fatty alcohol nonionic co-surfactant will frequently have a hydrophilic-lipophilic balance (HLB) which ranges from about 6 to 15, most preferably from about 10 to 15.

Examples of fatty alcohol ethoxylates useful as the nonionic co-surfactant component of the compositions herein will include those which are made from alcohols of 12 to 15 carbon atoms and which contain about 7 moles of ethylene oxide. Such materials have been commercially marketed under the tradenames Neodol 25-7 and Neodol 23-6.5 by Shell Chemical Company. Other useful Neodols include Neodol 1-5, ethoxylated fatty alcohol averaging 11 carbon atoms in its alkyl chain with about 5 moles of ethylene oxide; Neodol 23-9, an ethoxylated primary $C_{12}$–$C_{13}$ alcohol having about 9 moles of ethylene oxide and Neodol 91-10, an ethoxylated $C_9$–$C_{11}$ primary alcohol having about 10 moles of ethylene oxide. Alcohol ethoxylates of this type have also been marketed by Shell Chemical Company under the Dobanol tradename. Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles of ethylene oxide per mole of fatty alcohol.

Other examples of suitable ethoxylated alcohol nonionic surfactants include Tergitol 15-S-7 and Tergitol 15-S-9, both of which are secondary alcohol ethoxylates that have been commercially marketed by Union Carbide Corporation. The former is a mixed ethoxylation product of $C_{11}$ to $C_{15}$ linear secondary alkanol with 7 moles of ethylene oxide and the latter is a similar product but with 9 moles of ethylene oxide being reacted.

Other types of alcohol ethoxylate nonionics useful in the present compositions are higher molecular weight nonionics, such as Neodol 45-11, which are similar ethylene oxide condensation products of higher fatty alcohols, with the higher fatty alcohol being of 14–15 carbon atoms and the number of ethylene oxide groups per mole being about 11. Such products have also been commercially marketed by Shell Chemical Company.

Ethoxylated alcohol nonionic co-surfactants will frequently comprise from about 0.2% to 2% of the compositions herein. More preferably, such ethoxylated alcohols will comprise from about 0.5% to 1.5% of the compositions.

Another type of nonionic co-surfactant suitable for use in combination with the polyhydroxy fatty acid amides in the nonionic surfactant component herein comprises the ethylene oxide-propylene oxide block co-polymers that function as polymeric surfactants. Such block co-polymers comprise one or more groups which are hydrophobic and which contain mostly ethylene oxide moieties and one or more hydrophobic groups which contain mostly propylene oxide moieties. Such groups are attached to the residue of a compound that contained one or more hydroxy groups or amine groups. Such polymeric surfactants have a molecular weight ranging from about 400 to 60,000.

Preferred ethylene oxide-propylene oxide polymeric surfactants are those in which propylene oxide is condensed with an amine, especially a diamine, to provide a base that is then condensed with ethylene oxide. Materials of this type are marketed under the tradename Tetronic®. Similar structures wherein the ethylene diamine is replaced with a polyol such as propylene glycol are marketed under the tradename "Pluronic®". Preferred ethylene oxide-propylene oxide (EO-PO) polymeric surfactants have an HLB which ranges from about 4 to 30, more preferably about 10 to 20.

The ethylene oxide-propylene oxide block co-polymers used herein are described in greater detail in Pancheri/Mao; U.S. Pat. No. 5,167,872; Issued Dec. 2, 1992. This patent is incorporated herein by reference.

Ethylene oxide-propylene oxide block co-polymers will frequently be present to the extent of from about 0.1% to 2% of the compositions herein. More preferably, these polymeric surfactant materials will comprise from about 0.2% to 0.8% of the compositions herein.

Suds Boosters/Stabilizers

The compositions herein further include from about 2% to 6%, preferably from about 3% to 6%, of a suds booster or stabilizer component such as betaine surfactants, hydroxy-free fatty acid amides, amine oxide semi-polar nonionic surfactants, and $C_{8-22}$ alkyl polyglycosides. Combinations of these suds boosters/stablizers can also be used.

Betaine surfactants useful as suds boosters herein have the general formula:

$$R-\overset{(+)}{N}(R^1)_2-R^2\overset{(-)}{COO}$$

wherein R is a hydrophobic group selected from alkyl groups containing from about 10 to about 22 carbon atoms, preferably from about 12 to about 18 carbon atoms, alkyl aryl and aryl alkyl groups containing a similar number of carbon atoms with a benzene ring being treated as equivalent to about 2 carbon atoms, and similar structures interrupted by amido or ether linkages; each $R^1$ is an alkyl group containing from 1 to about 3 carbon atoms; and $R^2$ is an alkylene group containing from 1 to about 6 carbon atoms.

Examples of preferred betaines are dodecyl dimethyl betaine, cetyl dimethyl betaine, dodecyl amidopropyldimethyl betaine, tetradecyldimethyl betaine, tetradecylamidopropyldimethyl betaine, and dodecyldimethylammonium hexanoate. Other suitable amidoalkylbetaines are disclosed in U.S. Pat. Nos. 3,950,417; 4,137,191; and 4,375,421; and British Patent GB No. 2,103,236, all of which are incorporated herein by reference.

Hydroxy-free amide surfactants useful as suds boosters herein include the ammonia, monoethanol, and diethanol amides of fatty acids having an acyl moiety containing from about 8 to about 18 carbon atoms. Such materials are characterized herein as "hydroxy-free" in order to distinguish them from the polyhydroxy fatty acid amides essentially used in the nonionic surfactant component hereinbefore described. Accordingly, "hydroxy-free" amides, for purposes of this invention, are those wherein the acyl moiety contains no hydroxy substituents. These materials are represented by the formula:

$$R_1-CO-N(H)_{m-1}(R_2OH)_{3-m}$$

wherein $R_1$ is a saturated or unsaturated, hydroxy-free aliphatic hydrocarbon group having from about 7 to 21, preferably from about 11 to 17 carbon atoms; $R_2$ represents a methylene or ethylene group; and m is 1, 2, or 3, preferably 1. Specific examples of such amides are monoethanol amine coconut fatty acid amide and diethanolamine dodecyl fatty acid amide. These acyl moieties may be derived from naturally occurring glycerides, e.g., coconut oil, palm oil, soybean oil, and tallow, but can be derived synthetically, e.g., by the oxidation of petroleum or by hydrogenation of carbon monoxide by the Fischer-Tropsch process. The monoethanolamides and diethanolamides of $C_{12-14}$ fatty acids are preferred.

Amine oxide semi-polar nonionic surfactants useful as suds boosters/stabilizers comprise compounds and mixtures of compounds having the formula:

$$R_1-(C_2H_4O)_n-\overset{\overset{R^2}{|}}{\underset{\underset{R_3}{|}}{N}}\cdots O$$

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_1$ and $R_2$ are each methyl, ethyl, propyl, isopropyl, 2-hydroxyethyl, 2-hydroxypropyl, or 3-hydroxypropyl, and n is from 0 to about 10. Particularly preferred are amine oxides of the formula:

$$R_1-\overset{\overset{R_2}{|}}{\underset{\underset{R_3}{|}}{N}}\cdots O$$

wherein $R_1$ is a $C_{12-16}$ alkyl and $R_2$ and $R_3$ are methyl or ethyl. The above hydroxy-free amides, and amine oxides are more fully described in U.S. Pat. No. 4,316,824, incorporated herein by reference.

Other surfactants suitable for use as suds boosters/stabilizers in the compositions herein are the nonionic fatty alkylpolyglycosides. Such materials have the formula:

$$R_2O(C_nH_{2n}O)_y(Z)_x$$

wherein Z is derived from glucose, R is a hydrophobic group selected from alkyl, alkylphenyl, hydroxyalkylphenyl, and mixtures thereof in which said alkyl groups contain from 8 to 22, preferably from 12 to 14 carbon atoms; n is 2 or 3 preferably 2, y is from 0 to 10, preferably 0; and x is from 1.5 to 8, preferably from 1.5 to 4, most preferably from 1.6 to 2.7. U.S. Pat. Nos. 4,393,203 and 4,732,704, incorporated by reference, describe these alkyl polyglycoside surfactants.

Aqueous Liquid Carrier

The light duty dishwashing detergent compositions herein further contain from about 30% to 75% of an aqueous liquid carrier which forms the water phase of the oil-in-water microemulsions herein and in which the other essential and optional compositions components are dissolved, dispersed or suspended. More preferably the aqueous liquid carrier will comprise from about 35% to 60% of the compositions herein.

One essential component of the aqueous liquid carrier is, of course, water. The aqueous liquid carrier, however, may contain other materials which are liquid, or which dissolve in the liquid carrier, at room temperature and which may also serve some other function besides that of a simple filler. Such materials can include, for example, hydrotropes and solvents.

a) Hydrotropes

The aqueous liquid carrier may comprise one or more materials which are hydrotropes. Hydrotropes suitable for use in the compositions herein include the $C_1$–$C_3$ alkyl aryl sulfonates, $C_6$–$C_{12}$ alkanols, $C_1$–$C_6$ carboxylic sulfates and sulfonates, urea, $C_1$–$C_6$ hydrocarboxylates, $C_1$–$C_4$ carboxylates, $C_2$–$C_4$ organic diacids and mixtures of these hydrotrope materials.

Suitable $C_1$–$C_3$ alkyl aryl sulfonates include sodium, potassium, calcium and ammonium xylene sulfonates; sodium, potassium, calcium and ammonium toluene sulfonates; sodium, potassium, calcium and ammonium cumene sulfonates; and sodium, potassium, calcium and ammonium substituted or unsubstituted naphthalene sulfonates and mixtures thereof. Suitable $C_1$–$C_8$ carboxylic sulfate or sulfonate salts are any water soluble salts or organic compounds comprising 1 to 8 carbon atoms (exclusive of substituent groups), which are substituted with sulfate or sulfonate and have at least one carboxylic group. The substituted organic compound may be cyclic, acylic or aromatic, i.e. benzene derivatives. Preferred alkyl compounds have from 1 to 4 carbon atoms substituted with sulfate or sulfonate and have from 1 to 2 carboxylic groups. Examples of this type of hydrotrope include sulfosuccinate salts, sulfophthalic salts, sulfoacetic salts, m-sulfobenzoic acid salts and diester sulfosuccinates, preferably the sodium or potassium salts as disclosed in U.S. Pat. No. 3,915,903.

Suitable $C_1$–$C_4$ hydrocarboxylates and $C_1$–$C_4$ carboxylates for use herein include acetates and propionates and citrates. Suitable $C_2$–$C_4$ diacids for use herein include succinic, glutaric and adipic acids.

Other compounds which deliver hydrotropic effects suitable for use herein as a hydrotrope include $C_6$–$C_{12}$ alkanols and urea.

Preferred hydrotropes for use herein are sodium, potassium, calcium and ammonium cumene sulfonate; sodium, potassium, calcium and ammonium xylene sulfonate; sodium, potassium, calcium and ammonium toluene sulfonate and mixtures thereof. Most preferred are sodium cumene sulfonate and calcium xylene sulfonate and mixtures thereof. These preferred hydrotrope materials can be present in the composition to the extent of from about 3% to 8% by weight.

b) Solvents

In addition to the essentially present glycol ether microemulsion-forming solvents, a variety of other water-miscible liquids such as lower alkanols, diols, other polyols, ethers, amines, and the like may be used as solvents as part of the aqueous liquid carrier. Particularly preferred are the $C_{1-4}$ alkanols. Such solvents can be present in the compositions herein to the extent of from about 3% to 8%.

Liquid Hydrocarbon Component

The compositions herein essentially contain from about 2% to 7% of a liquid hydrocarbon component. More preferably, the liquid hydrocarbon component will comprise from about 1% to 5% of the detergent compositions herein. For purposes of this invention, a "liquid" hydrocarbon is one which is in liquid form at room temperature (20° C.).

The liquid hydrocarbon component forms the oil phase of the oil-in-water microemulsions that are prepared to provide the dishwashing detergent compositions herein. Such a hydrocarbon is, of course, water-insoluble. Hydrocarbons useful in microemulsion compositions of this type are frequently $C_6$–$C_{18}$ paraffins or isoparaffins. More preferably $C_8$–$C_{14}$ isoparaffins are utilized. Naturally occurring hydrocarbons such as terpenes may also be utilized.

Microemulsion-Forming Solvent

The microemulsion-forming solvent is a material that forms the oil-in-water or bicontinuous microemulsions from the aqueous liquid carrier and hydrocarbon components of the compositions herein. The mircroemulsion-forming solvents found to be useful in the compositions of the present invention are glycol ether materials.

The glycol ether microemulsion-forming solvents are the mono $C_{1-6}$ alkyl ethers of conventional glycol compounds. Suitable glycol ethers include 1 methoxy-2-propanol; 1 methoxy-3-propanol; 1 methoxy 2-,3- or 4-butanol; ethylene glycol monobutyl ether (butyl cellosolve); diethylene glycol monobutyl ether (butyl carbitol); triethylene glycol monobutyl ether; mono-, di-, tripropylene glycol monobutyl ether; tetraethylene glycol monobutyl ether; mono-, di-, tripropylene glycol monomethyl ether; propylene glycol monomethyl ether; ethylene glycol monohexyl ether; diethylene glycol monohexyl ether; propylene glycol tertiary butyl ether; ethylene glycol monoethyl ether; ethylene glycol monomethyl ether; ethylene glycol monopropyl ether; ethylene glycol monopentyl ether; diethylene glycol monomethyl ether; diethylene glycol monoethyl ether; diethylene glycol monopropyl ether; diethylene glycol monopentyl ether; triethylene glycol monomethyl ether; triethylene glycol monethyl ether; triethylene glycol monopropyl ether; triethylene glycol monopentyl ether; triethylene glycol monohexyl ether; mono-, di-, tripropylene glycol monoethyl ether; mono-, di-, tripropylene glycol monopropyl ether; mono-, di-, tripropylene glycol monopentyl ether; mono-, di-, tripropylene glycol monohexyl ether; mono-, di-, tributylene glycol monomethyl ether; mono-, di-, tributylene glycol monoethyl ether; mono-, di-, tributylene glycol monopropyl ether; mono-, di-, tributylene glycol monobutyl ether; mono-, di-, tributylene glycol monopentyl ether and mono-, di-, tributylene glycol monohexyl ether. Preferred glycol ether microemulsion-forming surfactants include diethylene glycol monobutyl ether (butyl carbitol) and dipropylene glycol monomethyl ether (Dowanol DPM).

The microemulsion-forming solvent will generally be present in the compositions herein to the extent from about 2% to about 10%. More preferably, the microemulsion-forming glycol ether solvent will comprise from about 3% to 7% of the compositions herein.

Optional Ingredients

Preferred optional ingredients in the dishwashing compositions herein include ancillary surfactants, calcium and/or magnesium ions, enzymes such as protease, a stabilizing system for the enzymes and a thickener. These and other optional ingredients are described as follows:

a) Ancillary Surfactants

The compositions herein may contain a wide variety of ancillary surfactants in addition to the essentially utilized surfactants hereinbefore described. Such ancillary surfactants, for example, can include $C_{8-22}$ alkyl sulfates; $C_{9-15}$ alkyl benzene sulfonates; $C_{8-22}$ olefin sulfonates; $C_{8-22}$ paraffin sulfonates; $C_{8-22}$ alkyl glyceryl ether sulfonates; fatty acid ester sulfonates; secondary alcohol sulfates; $C_12$-16 alkyl ethoxy carboxylates; $C_{11-16}$ secondary soaps; ampholytic detergent surfactants; and zwitterionic detergent surfactants.

b) Calcium and/or Magnesium Ions

The presence of calcium and/or magnesium (divalent) ions improves the cleaning of greasy soils for various compositions, i.e., compositions containing alkyl ethoxy sulfates and/or polyhydroxy fatty acid amides. This is especially true when the compositions are used in softened water that contains few divalent ions. It is believed that calcium and/or magnesium ions increase the packing of the surfactants at the oil/water interface, thereby reducing interfacial tension and improving grease cleaning.

Compositions of the invention herein containing magnesium and/or calcium ions exhibit good grease removal, manifest mildness to the skin, and provide good storage stability. These ions can be present in the compositions herein at an active level of from about 0.1% to 4%, preferably from about 0.3% to 3.5%, more preferably from about 0.5% to 1%, by weight.

Preferably, the magnesium or calcium ions are added as a hydroxide, chloride, acetate, formate, oxide or nitrate salt to the compositions of the present invention. Calcium ions may also be added as salts of the hydrotrope.

The amount of calcium or magnesium ions present in compositions of the invention will be dependent upon the amount of total surfactant present therein. When calcium ions are present in the compositions of this invention, the molar ratio of calcium ions to total anionic surfactant should be from about 0.25:1 to about 2:1.

Formulating such divalent ion-containing compositions in alkaline pH matrices may be difficult due to the incompatibility of the divalent ions, particularly magnesium, with hydroxide ions. When both divalent ions and alkaline pH are combined with the surfactant mixture of this invention, grease cleaning is achieved that is superior to that obtained by either alkaline pH or divalent ions alone. Yet, during storage, the stability of these compositions becomes poor due to the formation of hydroxide precipitates. Therefore, chelating agents discussed hereinafter may also be necessary.

c) Protease and/or Other Enzymes

The compositions of this invention can also optionally contain from about 0.001% to about 5%, more preferably from about 0.003% to about 4%, most preferably from about 0.005% to about 3%, by weight, of active protease, i.e., proteolytic, enzyme. Protease activity may be expressed in Anson units (AU.) per kilogram of detergent composition. Levels of from 0.01 to about 150, preferably from about 0.05 to about 80, most preferably from about 0.1 to about 40 AU. per kilogram have been found to be acceptable in compositions of the present invention.

Useful proteolytic enzymes can be of animal, vegetable or microorganism (preferred) origin. More preferred is serine proteolytic enzyme of bacterial origin. Purified or nonpurified forms of this enzyme may be used. Proteolytic enzymes produced by chemically or genetically modified mutants are included by definition, as are close structural enzyme variants. Particularly preferred is bacterial serine proteolytic enzyme obtained from *Bacillus subtilis* and/or *Bacillus licheniformis*.

Suitable proteolytic enzymes include Novo Industri A/S Alcalase® (preferred), Esperase®, Savinase® (Copenhagen, Denmark), Gist-brocades' Maxatase®, Maxacal® and Maxapem 15® (protein engineered Maxacal®) (Delft, Netherlands), and subtilisin BPN and BPN' (preferred), which are commercially available. Preferred proteolytic enzymes are also modified bacterial serine proteases, such as those made by Genencor International, Inc. (San Francisco, Calif.) which are described in European Patent EP-B-251,446, granted Dec. 28, 1994 and published Jan. 7, 1988 (particularly pages 17, 24 and 98) and which are also called herein "Protease B". U.S. Pat. No. 5,030,378, Venegas, issued Jul. 9, 1991, refers to a modified bacterial serine proteolytic enzyme (Genencor International) which is called "Protease A" herein (same as BPN'). In particular see columns 2 and 3 of U.S. Pat. No. 5,030,378 for a complete description, including amino sequence, of Protease A and its variants. Preferred proteolytic enzymes, then, are selected from the group consisting of Alcalase ® (Novo Industri A/S), BPN', Protease A and Protease B (Genencor), and mixtures thereof. Protease B is most preferred.

Another preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in WO 95/10615 published Apr. 20, 1995 by Genencor International.

Useful proteases are also described in PCT publications: WO 95/30010 published Nov. 9, 1995 by The Procter & Gamble Company; WO 95/30011 published Nov. 9, 1995 by The Procter & Gamble Company; WO 95/29979 published Nov. 9, 1995 by The Procter & Gamble Company.

Other optional enzymes such as lipase and/or amylase may be also added to the compositions of the present invention for additional cleaning benefits.

d) Enzyme Stabilizing System

The preferred compositions herein may additionally comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the protease or other enzymes used in the compositions herein. Such stabilizing systems can comprise calcium ion, boric acid, propylene glycol, short chain carboxylic acid, boronic acid, polyhydroxyl compounds and mixtures thereof such as are described in U.S. Pat. Nos. 4,261,868, Hora et al, issued Apr. 14, 1981; 4,404,115, Tai, issued Sep. 13, 1983; 4,318,818, Letton et al; 4,243,543, Guildert et al issued Jan. 6, 1981; 4,462,922, Boskamp, issued Jul. 31, 1984; 4,532,064, Boskamp, issued Jul. 30, 1985; and 4,537,707, Severson Jr., issued Aug. 27, 1985, all of which are incorporated herein by reference.

Additionally, from 0% to about 10%, preferably from about 0.01% to about 6% by weight, of chlorine bleach and oxygen bleach scavengers can be added to compositions of the present invention to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme during dishwashing is usually large; accordingly, enzyme stability in-use can be problematic.

Suitable chlorine scavenger anions are salts containing ammonium cations. These can be selected from the group consisting of reducing materials like sulfite, bisulfite, thiosulfite, thiosulfate, iodide, etc., antioxidants like carbonate, ascorbate, etc., organic amines such as ethylenediaminetetracetic acid (EDTA) or alkali metal salt thereof and monoethanolamine (MEA), and mixtures thereof. Other conventional scavenging anions like sulfate, bisulfate, carbonate, bicarbonate, percarbonate, nitrate, chloride, borate, sodium perborate tetrahydrate, sodium perborate monohydrate, percarbonate, phosphate, condensed phosphate, acetate, benzoate, citrate, formate, lactate, malate, tartrate, salicylate, etc. and mixtures thereof can also be used.

e) Thickener

The dishwashing detergent compositions herein may also contain a thickener material to alter microemulsion viscosity. Many suitable polymeric thickeners are known in the art. A preferred thickener for use in the microemulsion compositions of the present invention is hydroxypropyl methylcellulose.

Hydroxypropyl methylcellulose polymer has a number average molecular weight of about 50,000 to 125,000 and a viscosity of a 2 wt. % aqueous solution at 25° C. (ADTMD2363) of about 50,000 to about 100,000 cps. An especially preferred hydroxypropyl cellulose polymer is Methocel® J75MS-N wherein a 2.0 wt. % aqueous solution at 25° C. has a viscosity of about 75,000 cps. Especially preferred hydroxypropyl cellulose polymers are surface treated such that the hydroxypropyl cellulose polymer will ready disperse at 25° C. into an aqueous solution having a pH of at least about 8.5.

When formulated into the dishwashing detergent compositions of the present invention, the thickener will impart to the detergent composition a Brookfield viscosity of from about 500 to 3500 cps at 25° C. More preferably, a hydroxypropyl methylcellulose material is used to impart a viscosity of from about 1000 to 3000 cps at 25° C. For purposes of this invention, viscosity is measured with a Brookfield LVTDV-11 viscometer apparatus using an RV #2 spindle at 12 rpm.

The dishwashing detergent compositions herein can contain from about 0.2% to 2% of a thickener, especially a hydroxypropyl methylcellulose thickener. More preferably, such a thickener can comprise from about 0.5% to 2.5% of the compositions herein.

f) Miscellaneous Optional Ingredients

Other conventional optional ingredients which are usually used in additive levels of below about 5% include opacifiers, antioxidants, bactericides, dyes, perfumes, and the like. Furthermore, detergency builders can also be present in the compositions herein in amounts of from 0% to about 50%, preferably from about 2% to about 30%, most preferably from about 5% to about 15%. It is typical in light-duty liquid or gel dishwashing detergent compositions to have no detergent builder present. However, certain compositions containing magnesium or calcium ions may require the additional presence of low levels of, preferably from 0 to about 10%, more preferably from about 0.5% to about 3%, chelating agents selected from the group consisting of bicine/bis (2-ethanol)blycine), citrate N-(2-hydroxylethyl) iminodiacetic acid (HIDA), N-(2,3-dihydroxy-propyl) diethanolamine, 1,2-diamino-2-propanol N,N'-tetramethyl-1,3-diamino-2-propanol, N,N-bis(2-hydroxyethyl)glycine (a.k.a. bicine), and N-tris (hydroxymethyl)methyl glycine (a.k.a. tricine) are also preferred. Mixtures of any of the above are acceptable.

Composition pH

The dishwashing compositions of the present invention will generally provide a 10% aqueous solution pH of from about 4 to 11. More preferably, the compositions herein will be alkaline in nature with a 10% aqueous solution pH of from about 7 to 10.5.

Dishwashing compositions of the invention will be subjected to acidic stresses created by food soils when put to use, i.e., diluted and applied to soiled dishes. If a composition with a pH greater than 7 is to be more effective, it should contain a buffering agent capable of providing a generally more alkaline pH in the composition and in dilute solutions, i.e., about 0.1% to 0.4% by weight aqueous solution, of the composition. The pKa value of this buffering agent should be about 0.5 to 1.0 pH units below the desired pH value of the composition (determined as described above). Preferably, the pKa of the buffering agent should be from about 7 to about 9.5. Under these conditions the buffering agent most effectively controls the pH while using the least amount thereof.

The buffering agent may be an active detergent in its own right, or it may be a low molecular weight, organic or inorganic material that is used in this composition solely for maintaining an alkaline pH. Preferred buffering agents for compositions of this invention include nitrogen-containing materials. Some examples of nitrogen compounds are amino acids or lower alcohol amines like mono-, di-, and triethanolamine. Useful inorganic buffers/alkalinity sources include the alkali metal carbonates, e.g., sodium carbonate.

The buffering agent, if used, is present in the compositions of the invention herein at a level of from about 0.1% to 15%, preferably from about 1% to 10%, most preferably from about 2% to 8%, by weight of the composition.

Composition Preparation

Because the compositions as prepared are aqueous liquid formulations and since no particular mixing is required to form the o/w or bicontinuous microemulsion, the compositions are easily prepared simply by combining all the ingredients in a suitable vessel or container using suitable agitation. The order of mixing the ingredients is not particularly important, and generally the various ingredients can be added sequentially or all at once or in the form of aqueous or hydrocarbon solutions of each or all of the components. It is not necessary to use elevated temperatures in the formation step, and room temperature is sufficient.

Dishwashing Method

Soiled dishes can be contacted with an effective amount, typically from about 0.5 ml. to about 20 ml. (per 25 dishes being treated), preferably from about 3 ml. to about 10 ml., of the detergent composition of the present invention. The actual amount of liquid detergent composition used will be based on the judgment of user, and will typically depend upon factors such as the particular product formulation of the composition, including the concentration of active ingredient in the composition, the number of soiled dishes to be cleaned, the degree of soiling on the dishes, and the like. The particular product formulation, in turn, will depend upon a number of factors, such as the intended market (i.e., U.S., Europe, Japan, etc.) for the composition product. The following are examples of typical methods in which the detergent compositions of the present invention may be used to clean dishes. These examples are for illustrative purposes and are not intended to be limiting.

In a typical U.S. application, from about 3 ml. to about 15 ml., preferably from about 5 ml. to about 10 ml. of a liquid detergent composition is combined with from about 1,000 ml. to about 10,000 ml., more typically from about 3,000 ml. to about 5,000 ml. of water in a sink having a volumetric capacity in the range of from about 5,000 ml. to about 20,000 ml., more typically from about 10,000 ml. to about 15,000 ml. The detergent composition has a surfactant mixture concentration of from about 21% to about 44% by weight, preferably from about 25% to about 40% by weight. The soiled dishes are immersed in the sink containing the detergent composition and water, where they are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

In a typical European market application, from about 3 ml. to about 15 ml., preferably from about 3 ml. to about 10 ml. of a liquid detergent composition is combined with from about 1,000 ml. to about 10,000 ml., more typically from about 3,000 ml. to about 5,000 ml. of water in a sink having a volumetric capacity in the range of from about 5,000 ml. to about 20,000 ml., more typically from about 10,000 ml. to about 15,000 ml. The detergent composition has a surfactant mixture concentration of from about 20% to about 50% by weight, preferably from about 30% to about 40%, by weight. The soiled dishes are immersed in the sink containing the detergent composition and water, where they are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

In a typical Latin American market application, from about 1 ml. to about 50 ml., preferably from about 2 ml. to about 10 ml. of a detergent composition is combined with from about 50 ml. to about 2,000 ml., more typically from about 100 ml. to about 1,000 ml. of water in a bowl having a volumetric capacity in the range of from about 500 ml. to about 5,000 ml., more typically from about 500 ml. to about 2,000 ml. The detergent composition has a surfactant mixture concentration of from about 5% to about 40% by weight, preferably from about 10% to about 30% by weight. The soiled dishes are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

Another dishwashing method used worldwide involves direct application of the detergent compositions herein, either neat or diluted in a dispenser bottle, onto the soiled dishes to be cleaned. This can be accomplished by using a device for absorbing liquid dishwashing detergent, such as a sponge or dishrag, which is placed directly into a separate quantity of undiluted or somewhat diluted liquid dishwashing composition for a period of time typically ranging from about 1 to about 5 seconds. The absorbing device, and consequently the undiluted or somewhat diluted liquid dishwashing composition, can then be contacted individually with the surface of each of the soiled dishes to remove food soil. The absorbing device is typically contacted with each dish surface for a period of time ranging from about 1 to about 10 seconds, although the actual time of application will be dependent upon factors such as the degree of soiling of the dish. The contacting of the absorbing device with the dish surface is preferably accompanied by concurrent scrubbing. Prior to contact and scrubbing, this method may involve immersing the soiled dishes into a water bath without any liquid dishwashing detergent. After scrubbing, the dish can be rinsed under running water.

The following Example illustrates the invention and facilitates its understanding.

EXAMPLE

A light-duty liquid dishwashing detergent formula having the following composition is prepared in the form of a microemulsion:

| Ingredient | Concentration (Wt. %) |
|---|---|
| Sodium $C_{12-13}$ alkyl ethoxy (1–3) sulfate | 30 |
| $C_{12-14}$ Glucose Amide | 4 |
| Coconut amine oxide | 4 |
| EO/PO Block Co-polymer - Tetronic ® 704 | 0.5 |
| Ethanol | 7 |
| Calcium/sodium xylene sulfonate | 5.5 |
| Neodol ® $C_{11}E_9$ alcohol ethoxylate | 1 |
| Perfume | 0.2 |
| Magnesium$^{++}$ (added as chloride) | 6.0 |
| Isoparaffin (Isopar H ®) | 3.0 |
| Dipropylene glycol methyl ether (Dowanol DPM ®) | 5.0 |
| Water and minors | Balance to 100% |
| pH @ 10% (as made) | 7.5 |

What is claimed is:

1. A light duty liquid detergent composition which is in the form of an oil-in-water or bicontinuous microemulsion and which has especially desirable greasy soil removal and sudsing performance when used to clean heavily soiled dishware, said composition comprising A) from about 20 % to 40% by weight of an anionic surfactant component which comprises alkyl ether sulfates containing from about 8 to 18 carbon atoms in the alkyl group and from about 1 to 6 moles of ethylene oxide;

B) i) from about 0.2% to 2.0% by weight of the composition of a nonionic co-surfactant selected from the group consisting of $C_{8-18}$ alcohol ethoxylate having from about 1 to 15 moles of ethylene oxide, ethylene oxide-propylene oxide block copolymer surfactants and combinations of said nonionic co-surfactants with ii) from about 3% to 10% by weight of a nonionic surfactant component which comprises surfactants selected from the group consisting of $C_{8-18}$ polyhydroxy fatty acid amides and combinations of said polyhydroxy fatty acid amides;

C) from about 2% to 6% by weight of a suds booster/stabilizer selected from the group consisting of betaine surfactants, hydroxy-free fatty acid amides, amine oxide semipolar nonionic surfactants, $C_{8-22}$ alkylpolyglycosides and combinations of said suds boosters/stabilizers;

D) from about 30% to 75% by weight of an aqueous liquid carrier;

E) from about 2.0% to 7.0% by weight of a liquid hydrocarbon component; and

F) from about 2% to 10% by weight of a microemulsion-forming solvent which is a glycol ether and which is effective to form an oil-in-water or bicontinuous microemulsion from said hydrocarbon and aqueous liquid carrier components.

2. A light duty liquid detergent composition which is in the form of an oil-in-water microemulsion and which has desirable greasy soil removal and sudsing performance when used to clean heavily soiled dishware, said composition comprising A) from about 25 % to 35% by weight of an alkyl ether sulfate containing from about 10 to 16 carbon atoms in the alkyl group and from about 1 to 3 moles of ethylene oxide;

B) from about 3% to 5% by weight of $C_{10-16}$ polyhydroxy fatty acid amides;

C) from about 0.5% to 1.5% by weight of a $C_{10-14}$ alcohol ethoxylate having from about 8 to 12 moles of ethylene oxide;

D) from about 0.2% to 0.8% by weight of a polymeric surfactant comprising ethylene oxide and propylene oxide condensed with ethylene diamine to form a block co-polymer having a molecular weight of from about 4000 to 6000 and an HLB of from about 10 to 20;

E) from about 3% to 6% by weight of a coconut alkyldimethylamine oxide;

F) from about 4% to 8% by weight of one or more water-soluble inorganic salts of magnesium or calcium;

G) from about 35% to 60% by weight of an aqueous liquid carrier which comprises from about 3% to 8% by weight of the composition of a hydrotrope selected from alkali metal and calcium xylene and toluene sulfonates and from about 3% to 8% by weight of the composition of a solvent selected from $C_{1-4}$ alkanols;

H) from about 1% to 5% by weight of a $C_{6-18}$ isoparaffin compound; and

I) from about 3% to 7% by weight of dipropylene glycol methyl ether which is effective to form an oil-in-water or bicontinuous microemulsion from said isoparaffin and aqueous liquid carrier components.

* * * * *